United States Patent [19]

Dooley

[11] Patent Number: 4,957,204

[45] Date of Patent: Sep. 18, 1990

[54] CONTAINER FOR PACKAGING CARPENTER SQUARES

[76] Inventor: Ronald J. Dooley, 9 Rensselaer St., Hoosick Falls, N.Y. 12090

[21] Appl. No.: 407,540

[22] Filed: Sep. 15, 1989

[51] Int. Cl.[5] ..... B65D 85/28

[52] U.S. Cl. ..... 206/371; 206/349; 206/476; 206/477; 206/482

[58] Field of Search ..... 206/349, 372, 371, 476, 206/477, 482, 491, 492, 450, 453; 229/40, 167

[56] References Cited

U.S. PATENT DOCUMENTS

| | | | |
|---|---|---|---|
| 2,526,052 | 10/1950 | Stimmel | 206/453 |
| 2,684,758 | 7/1954 | Aquino . | |
| 2,870,951 | 1/1959 | Struble | 229/167 |
| 3,115,154 | 12/1963 | Rumsey, Jr. | 206/491 |
| 3,211,282 | 10/1965 | Hennessey | 206/491 |
| 3,383,028 | 5/1968 | Brander | 206/491 |
| 3,604,560 | 9/1971 | Fraquhar | 229/40 |
| 3,790,065 | 2/1974 | Carpenter . | |
| 3,792,811 | 2/1974 | Carpenter . | |
| 3,939,978 | 2/1976 | Thomaswick | 206/453 |
| 4,042,168 | 8/1977 | Kasel et al. . | |
| 4,046,311 | 9/1977 | Voytko . | |
| 4,113,096 | 9/1978 | Scott . | |
| 4,174,778 | 11/1979 | Klomp et al. | 206/482 |
| 4,186,868 | 2/1980 | Coleman | 206/492 |
| 4,300,687 | 11/1981 | Gardner et al. | 206/491 |

*Primary Examiner*—David T. Fidei
*Attorney, Agent, or Firm*—Heslin & Rothenberg

[57] ABSTRACT

A container for packaging carpenter squares is formed from a one-piece blank of corrugated paper, or the like, and comprises a bottom panel with receiving flaps for receiving interlocking flaps which tuck and hold the carpenter squares in place to prevent slippage during shipping. Top flaps are appended to the bottom panel for closing the container and for receiving an adhesive means for sealing.

22 Claims, 7 Drawing Sheets

CONTAINER FOR PACKAGING CARPENTER SQUARES

BACKGROUND OF THE INVENTION

I. Field of the Invention

This invention relates to the field of packaging and, more particularly, to a container for packaging and shipping of carpenter squares.

II. Description of Prior Art

For over 20 years, because of the unusual "L" shape of carpenter squares, packaging for shipment of carpenter squares generally consisted of a triangular shaped package. The previously used triangular packaging suffered from a number of deficiencies. The packages were difficult to pack because manual rolling of the corrugated material around the carpenter squares was required. The rolling of the material around the carpenter square caused numerous incidents of injuries to packaging employees from the repeated manual act of rolling the corrugated material.

In addition, the triangular packages had to be stapled closed which sometimes damaged the carpenter squares contained therein. The triangular packages also did not stack or ship well, because the side opposite the right angle of the packaged carpenter squares often collapsed during stacking or shipment.

To alleviate the problems with triangular packaging, rectangular packaging was attempted for packaging of carpenter squares. However, when multiple carpenter squares were stacked or piled in the prior rectangular packages, the squares would slide and slip around inside the package because they were not able to be locked in place. Arrangement of multiple carpenter squares in a rectangular pattern whereby the ends of each square were nominally held in place by the ends of the other squares also was unsatisfactory and resulted in slippage. Such slippage during shipping caused damage to the squares and to the packaging.

Of the known containers for packaging carpenter squares, none have the capacity to contain multiple carpenter squares, while at the same time avoiding slippage of the squares, manual rolling and stapling of the container. A need thus persists for a container for carpenter squares which ensures the safe, secure and convenient shipment and storage of such squares.

SUMMARY OF THE INVENTION

This need is satisfied and the shortcomings of the prior art overcome, in accordance with the principles of the present invention, by the provision of a container for packaging carpenter squares which holds carpenter squares in place with the squares stacked in two piles arranged end to end in a rectangle pattern. The container is formed from a one-piece blank having a rectangular bottom panel with interlock flaps extending from at least two edges of the bottom panel. Each interlock flap is folded over the top of the adjacent pile of carpenter squares and tucked underneath a corresponding receiving flap contained in the bottom panel of the container. The tucking of the interlock flap underneath the receiving flap renders the carpenter squares immobile. Top flaps extending from the other edges of the bottom panel can then be folded over the contents and sealed to each other and to the container by tape or other similar type of sealing.

In one aspect of the invention, the container is preferably provided with a tab at either side of each interlock flap which tabs can be selectively folded under to serve as a shim when an odd number of squares are packaged in the container.

In a further aspect of the invention, a punch-out or aperture can be provided at the inner end of the slice-cut or border between each interlock flap and adjoining tab in order to reduce stress and tearing between the interlock flap and the tab.

Accordingly, it is a principal object of this invention to improve the packaging of carpenter squares as compared to the presently available packaging.

One significant feature of this invention is the creation of a locking mechanism integral with the packaging to immobilize the carpenter squares during shipment. Another feature is the ability of the new container to accommodate an odd number of squares and still prevent slipping.

One advantage of this invention is the reduction of the slipping of packaged carpenter squares during shipment. A further advantage of this invention is that manual labor required for packaging carpenter squares is reduced.

A still further advantage of this invention is that it allows for taping or similar sealing of the container for packaging carpenter squares, as opposed to the present method of stapling.

A still further advantage of this invention is that the containers containing the carpenter squares are easily stacked on top of each other and resist collapsing.

BRIEF DESCRIPTION OF THE DRAWINGS

These and other objects, aspects, features and advantages of the present invention will be more readily understood from the following detailed description when read in conjunction with the accompanying drawings, in which.

DESCRIPTION OF THE PREFERRED EMBODIMENTS

Figure 1:
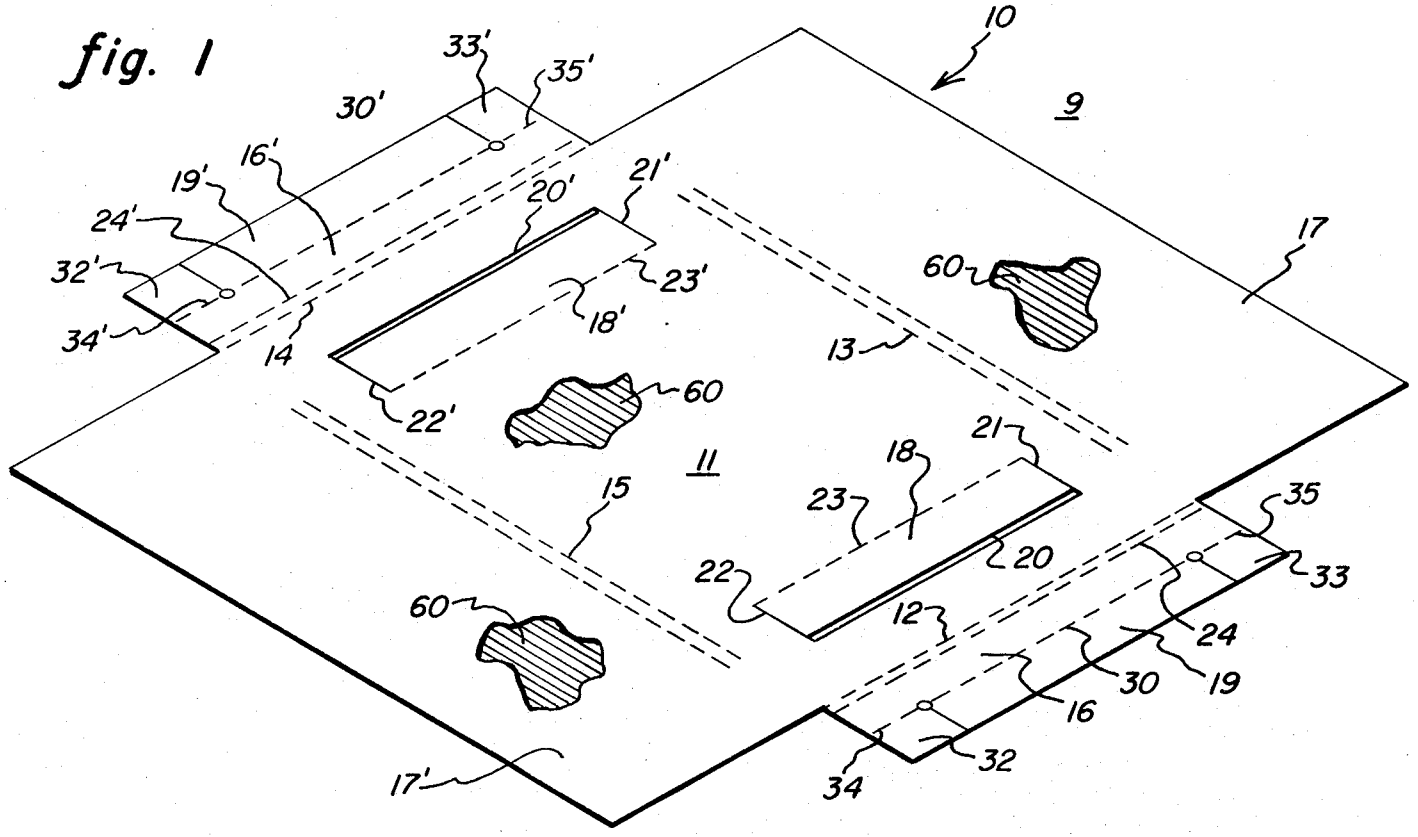
FIG. 1 is a perspective view of a typical one-piece blank of corrugated paper from which a container for carpenter squares is folded, in accordance with the principles of the present invention.

Referring now to the drawings in detail, FIG. 1 shows a one-piece die-cut blank 10 of corrugated paper material or the like which is scored and cut to form the different flaps and panel comprising container 9 of the present invention. As seen in FIG. 1, the corrugated grain 60 of the container 9, preferably runs in a lengthwise direction. Blank 10 includes a panel 11 comprising the bottom of container 9. Bottom panel 11 has a substantially rectangular shape with its edges being defined by regular type score lines 12 and 14 and ½ inch by ½ inch "cut and crease" or perforated score lines 13 and 15. Extending outwardly from the edges of the bottom panel 11 are tuck flaps 16 and 16' and the top flaps 17 and 17'. Tuck flaps 16 and 16' include interlock flaps 19 and 19', respectively. Each interlock flap 19 and 19' has a regular type score line 30 and 30' which enables the interlock flap to be maneuvered in a direction distinct from the associated tuck flap 16 and 16'. The regular type score lines 12 and 14 are used for folding the tuck flaps 16 and 16' and the perforated score lines 13 and 15 are used for folding the top flaps 17 and 17' in a substantially perpendicular direction to the bottom panel 11. Scored tabs 32 and 33, 32' and 33', are located on alternate sides of interlock flaps 19 and 19', respectively, as seen in FIG. 1, and are discussed below.

Figure 2:
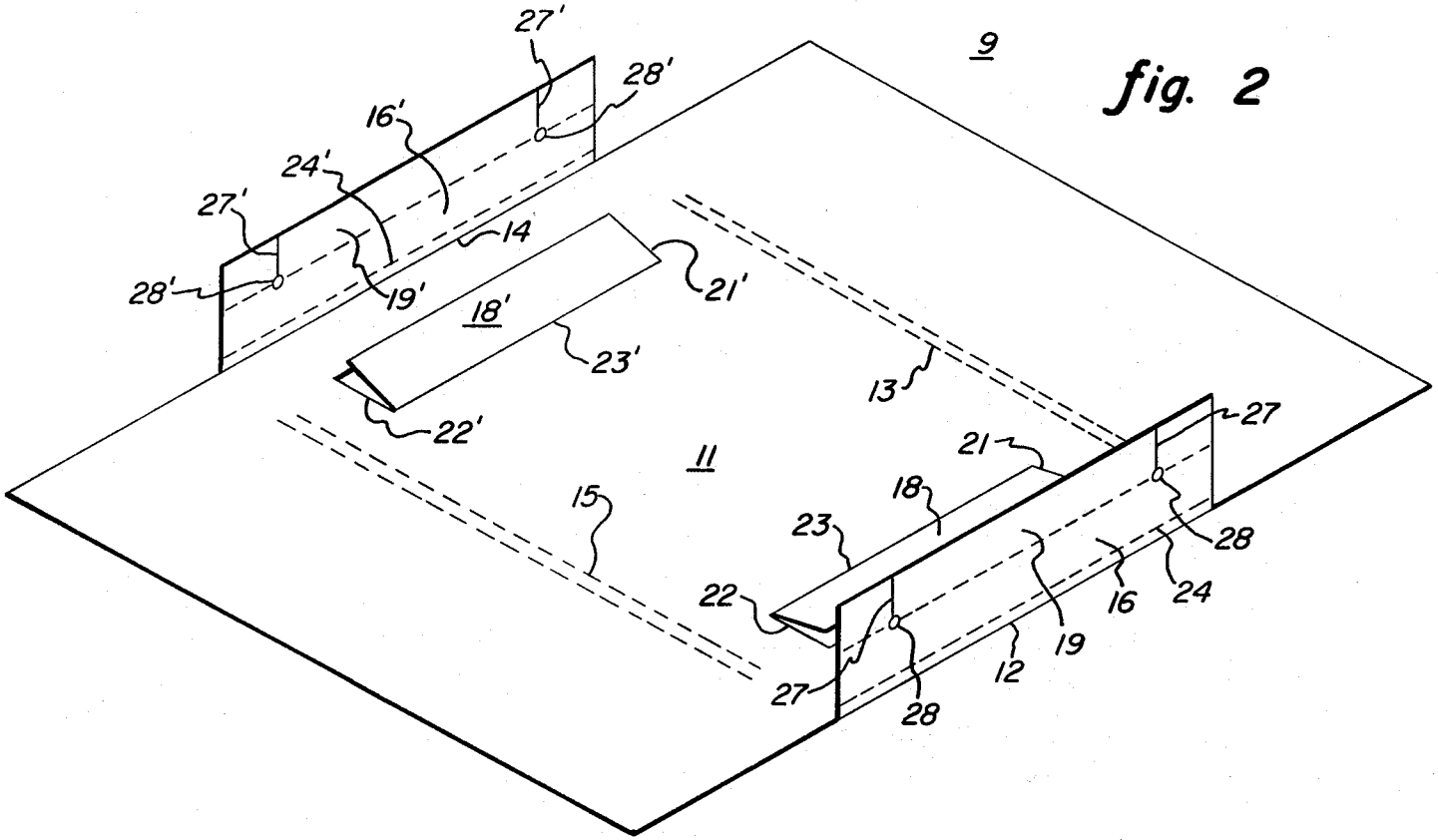
FIG. 2 is a perspective view of the blank for carpenter squares of FIG. 1 showing tuck flaps folded perpendicular to a bottom panel, and receiving flaps folded in an upwardly direction.

As shown in FIG. 1 the bottom panel 11 contains a pair of receiving flaps 18 and 18', which are capable of receiving the adjacent interlock flaps 19 and 19'. Receiving flaps 18 and 18' are defined by a cut-out 20 and 20' along the edge of the receiving flap which is parallel and facing the adjacent edge 12 and 14, respectively, of the bottom panel 11. At each end of each cut-out 20 and 20', there are knife-cuts 21 and 22, and 21' and 22', running in the direction away from the adjacent edge 12 and 14, respectively, of the bottom panel 11. A perforated score line 23 and 23' connects the knife-cuts 21 and 22, and, 21' and 22', respectively, to allow the receiving flap 18 and 18' to be moved in an upwardly direction, as shown in FIG. 2, for receiving the adjacent interlock flaps 19 and 19', respectively. Although it is preferable to have moveable receiving flaps 18 and 18' of the type shown, any type of means which is capable of receiving the interlock flaps 19 and 19' would be adequate. For example, a slot or an immobilized flap would be satisfactory.

As depicted in FIG. 2, the tuck flaps 16 and 16' are provided with regular type score lines 24 and 24' at a distance from score lines 12 and 14 respectively, corresponding to the approximate desired height of the container. The tuck flaps 16 and 16' are folded over at the score lines 24 and 24' so that the portion of the tuck flap 16 and 16' which is perpendicular to the bottom panel 11 defines the approximate height of the container, and the portion of the tuck flap 16 and 16' which is parallel with the bottom 11 is pointed in the direction of the adjacent receiving flap 18 and 18'. The interlock flaps 19 and 19' are preferably of a width substantially equal to the receiving flaps 18 and 18', and are defined by slice-cuts 27 and 27' at each end, which terminate in punch-outs 28 and 28'. Punch-outs 28 and 28' relieve tearing of the corrugated material. Although the punch-outs are shown as being round, the punch-outs 28 and 28' may define any shaped aperture.

Figure 3:
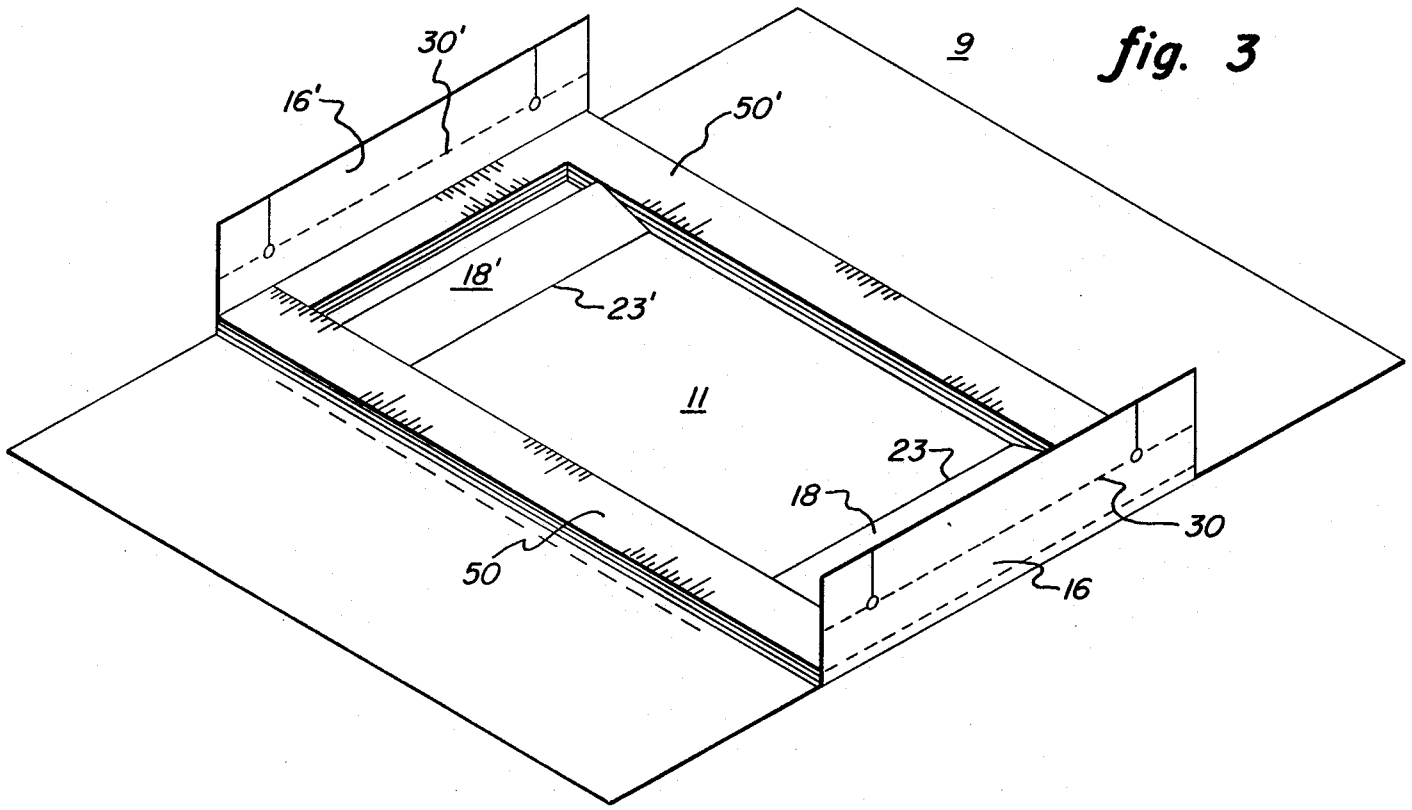
FIG. 3 is a perspective view of the container of FIG. 2 depicting an arrangement of carpenter squares located therein.

FIG. 3 shows an arrangement of two piles of carpenter squares 50 and 50' on the bottom panel 11 of the container 9. The two piles of carpenter squares 50 and 50' are arranged in piles of 3 squares each, with the piles arranged end to end in a rectangular pattern. It is contemplated that the container 9 can be easily adopted to accommodate any number of carpenter squares when arranged in a similar end to end pattern.

Figure 4:
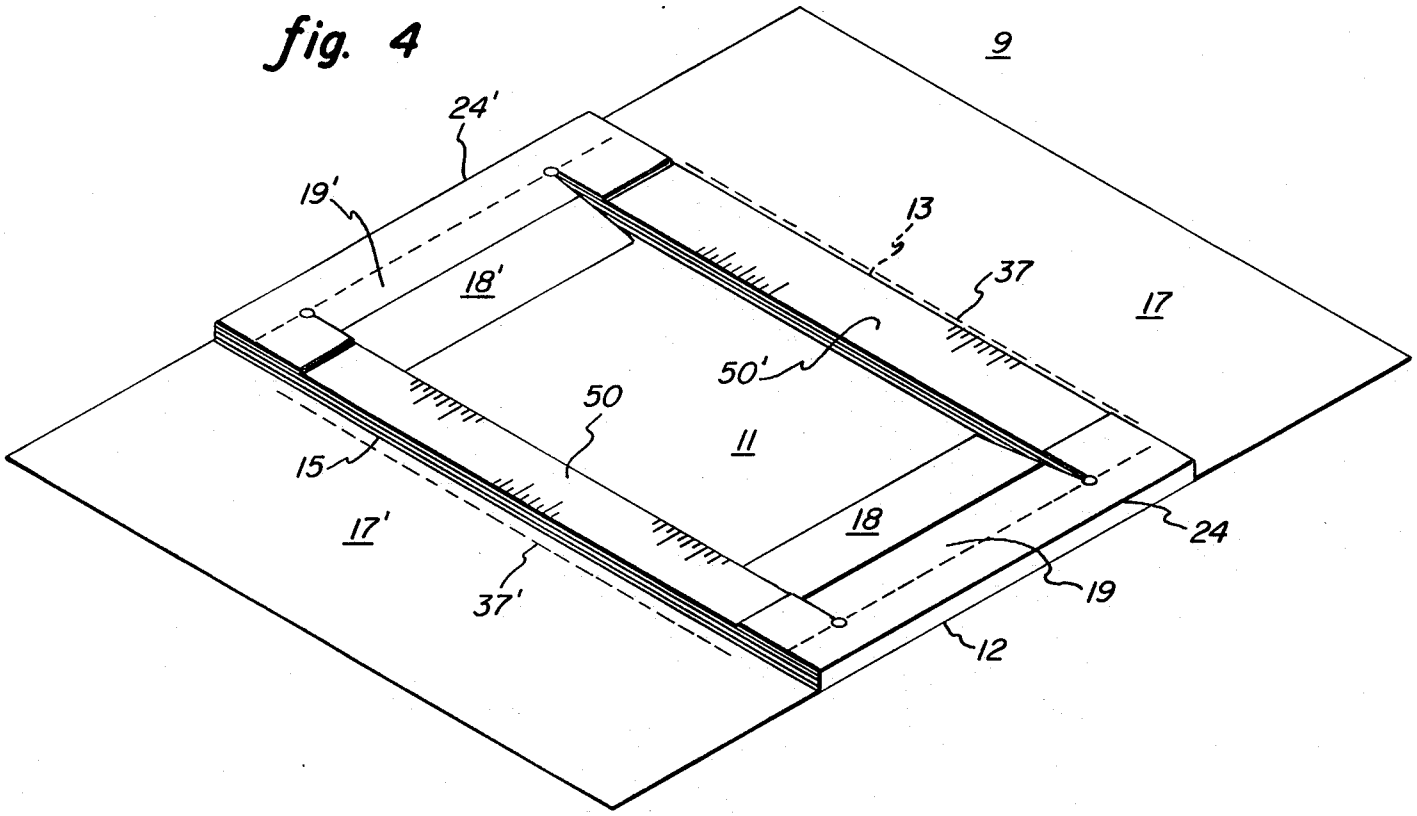
FIG. 4 is a perspective view, with squares, of the blank of FIG. 1 showing interlock flaps tucked underneath corresponding receiving flaps.

FIG. 4 shows the container with carpenter squares with the interlock flaps 19 and 19' tucked underneath the receiving flaps 18 and 18', respectively. With the carpenter squares 50 and 51' in place, the folding of the tuck flap 16 and 16' over the carpenter squares 50 and 50' and the tucking of the interlock flaps 19 and 19' underneath the receiving flaps 18 and 18' prevents slippage of the carpenter squares in every direction.

Top flaps 17 and 17' are adjacent to the perforated score lines 13 and 15 of the bottom panel 11 and contain a perforated score line 37 and 37' to define the height of the container. The score lines 37 and 37' are positioned so as to allow the top flaps 17 and 17' to fold over the tuck flaps 16 and 16' when the tuck flaps 16 and 16' are folded at score lines 24 and 24'. Therefore, the distance between edges 13 and 15 and score lines 37 and 37' is slightly greater than the distance between edges 12 and 14 and score lines 24 and 24', to allow top flap 17 and 17' to close neatly over the contents of the container 9.

Figure 5:
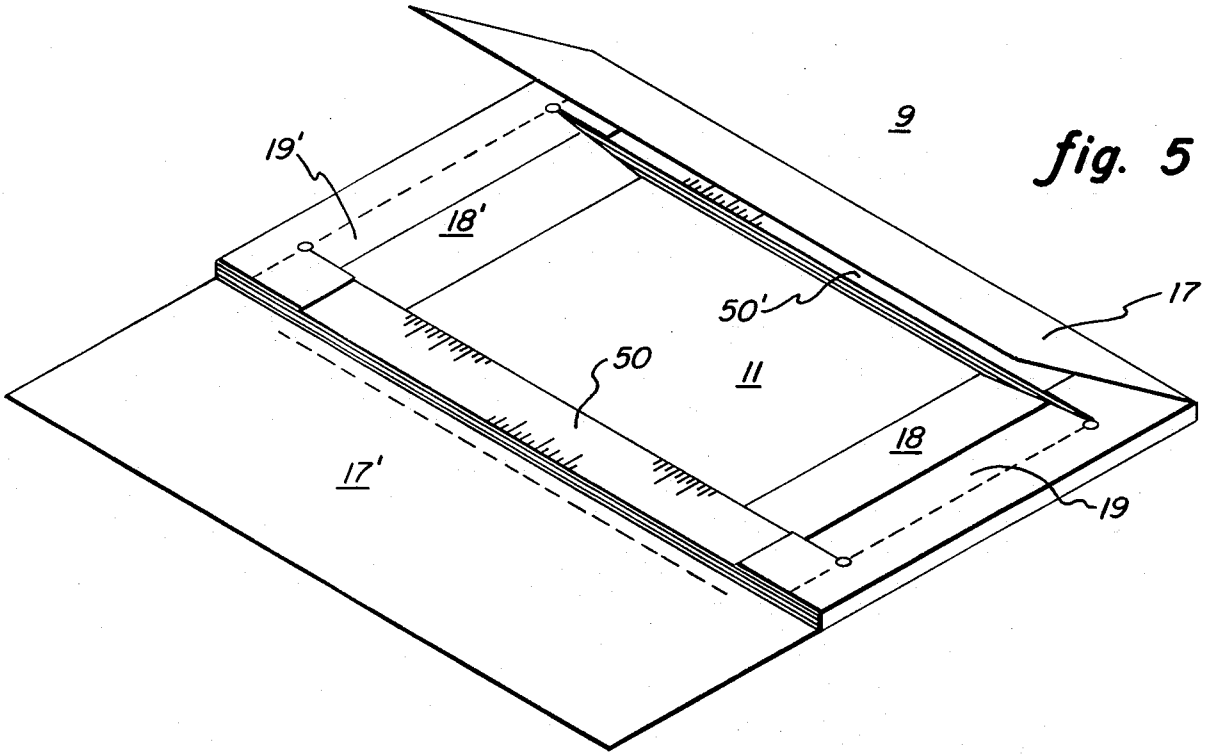
FIG. 5 is a perspective view of the blank of FIG. 1 containing the carpenter squares and showing a first top flap being folded over the immobilized carpenter squares.

FIG. 5 shows how the top flaps 17 and 17' are folded over the carpenter squares 50 and 50' after the interlock flaps 19 and 19' are tucked underneath the receiving flaps 18 and 18', in order to close the container 9.

Figure 6:
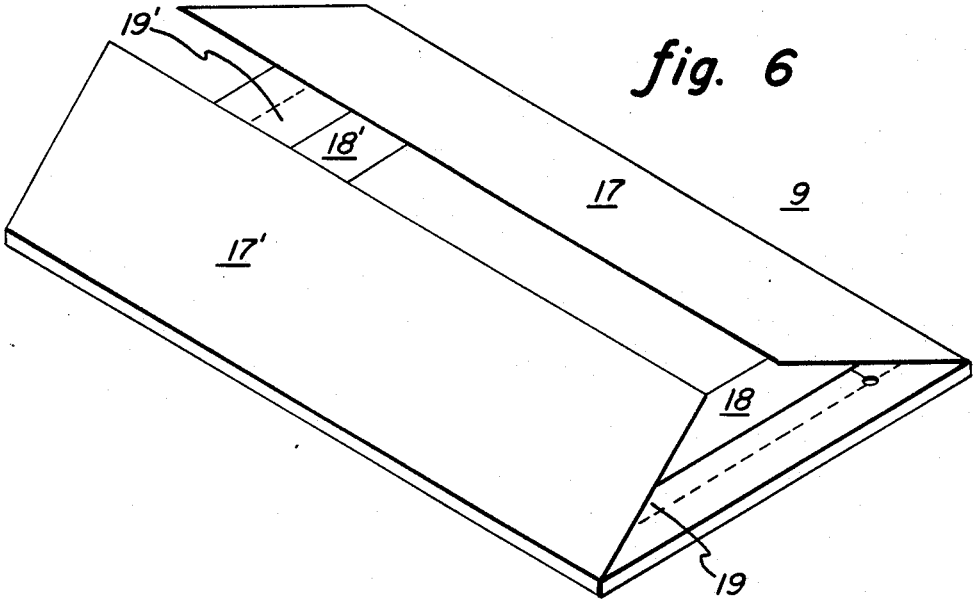
FIG. 6 is a perspective view of the blank of FIG. 1 showing both top flaps being folded over the immobilized squares.

FIG. 6 shows the the container 9 in a partially closed position.

Figure 7:
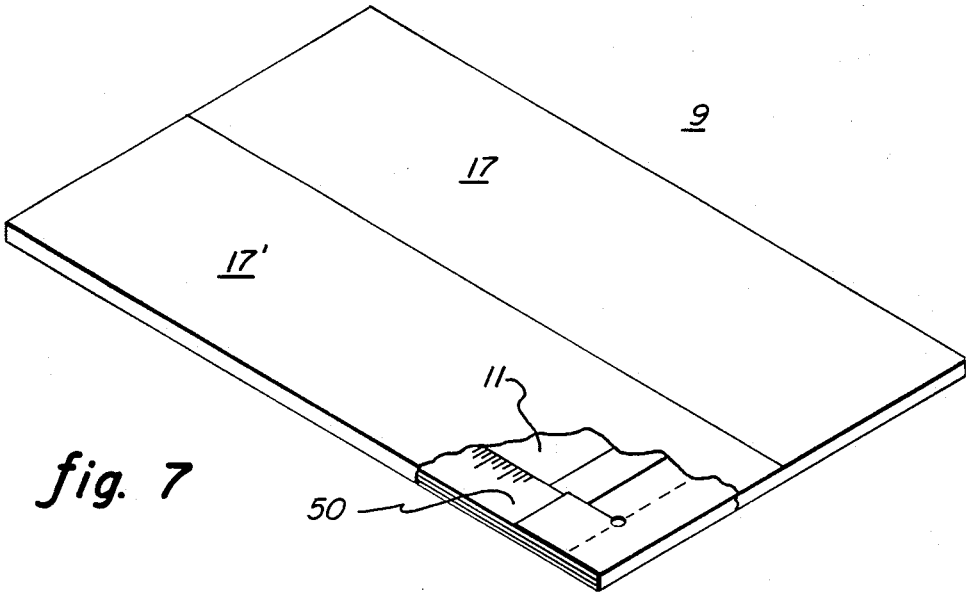
FIG. 7 is a cut-away perspective view of the blank of FIG. 1 in a closed position, showing one pile of carpenter squares immobilized by the interlock flap being folded over the pile of squares and tucked underneath the receiving flap.

FIG. 7 shows the container 9 as closed by placing the top flaps 17 and 17' in a plane parallel with the bottom panel 11, and over the immobilized piles of squares 50 and 51'. The flat surfaced container 9 displayed in FIG. 7 is easily capable of being run through a commercially available taping machine or other adhesive fastening device.

Figure 8:
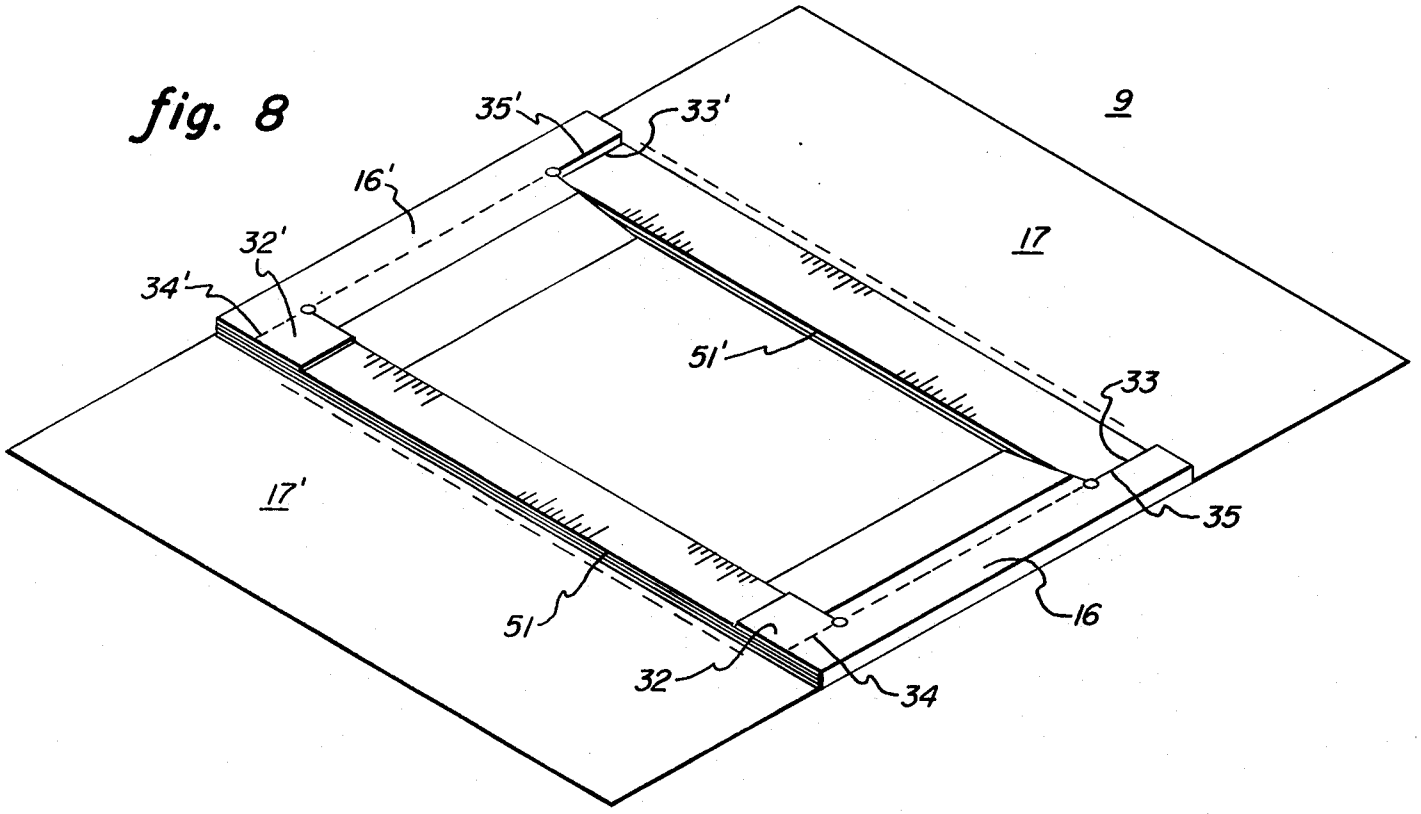
FIG. 8 is a perspective view of the blank of FIG. 1 containing an odd number of squares arranged in two piles and using a tab on the tuck flap as a shim.

In a preferred embodiment of this invention, best illustrated in FIG. 8, tabs 32 and 33, and 32' and 33', disposed on alternate sides of interlock flaps 19 and 19' respectively, are provided with a regular type score line 34, 35, 34' and 35' for selective folding of tabs under the tuck flap 16 and 16' to enable said folded tabs 33 and 33' to act as a shim for packaging an odd number of carpenter squares.

Normally, the packaged carpenter squares are piled end to end in rectangular fashion and divided evenly between the two piles 51 and 51'. When an odd number of squares are divided between the two piles, the pile 51' which has the fewer carpenter squares will cause a gap between it and the tuck flap 16 and 16'. Tab 33 and tab 33' can be folded under to create a shim to fill the gap.

A container constructed in accordance with the teachings herein has been successfully used to package two foot carpenter squares. The container made of corrugated material of the type commercially sold as 200 pound test "C" flute stock is dimensioned as follows:

The width of the bottom panel 11 between the perforated score lines or edges 13 and 15 is 16 3/16 inches; the length of each perforated score lines or edge 13 and 15 is 19 11/16 inches, with a three inch regular type scored margin on each end of each perforated score line or edge 13 and 15. The length of the bottom panel 11 between regular type score lines or edges 12 and 14 is 25 11/16 inches; the length of regular type score lines or edges 12 and 14 is 16 1/16 inches. The width of top flaps 17 and 17' from edges 13 and 15 to the outer edges of top flaps 17 and 17' is 8 13/16 inches. The length of the top flaps 17 and 17' is 25 11/16 inches. The distance between edges 13 and 15 and perforated score lines 37 and 37', respectively, is approximately $\frac{5}{8}$ of an inch, which corresponds to the height of the container when folded. Perforated score lines 37 and 37' are each 19 11/16 inches long with a three inch regular type scored margin on each end of each perforated score line 37 and 37'. The distance between edges 12 and 14 and score lines 24 and 24' respectively, is $\frac{1}{2}$ of an inch, which is slightly less than the total height of the container when folded, because top flaps 17 and 17' fold over the tuck flaps 16 and 16'.

The cut-outs 20 and 20' are located $2\frac{1}{4}$ inches from edges 12 and 14 respectively and are $\frac{1}{4}$ inch deep. Each cut out 20 and 20' is 11 13/16 inches wide, said width being parallel with edges 12 and 14, respectively. The knife-cuts 21, 22, 21' and 22' are two inches long and perforated score lines 23 and 23' are 11 13/16 inches.

The distance between regular type score lines 24 and 24' and the outside parallel edges of tuck flaps 16 and 16' is $3\frac{1}{2}$ inches. The distance between regular score lines 30 and 30' and the outside edges of tuck flaps 16 and 16', is $1\frac{7}{8}$ inches. This distance equals the depth of the interlock flaps 19 and 19'.

The width of the interlock flaps 19 and 19' is 11 13/16 inches, which is equal to the space between the borders or slice-cuts 27 and 27' of the tabs 32, 33, 32' and 33'. The tabs 32 and 33, and 32' and 33' are each $2\frac{1}{8}$ inches wide and $1\frac{3}{4}$ inches deep from the score lines 34 and 35 and 34' and 35' to the outside edge of the tabs. (Therefore, the slice-cuts 27 and 27' are also $1\frac{3}{4}$ inches long). Thus, the width of the entire tuck flap 19 and 19' equals 16 1/16 inches. The punch outs 28 and 28' are apertures of approximately $\frac{1}{4}$ inch in diameter.

A container with these measurements would have an inside dimension of $25\frac{1}{2}\times16\times5/16$ inches. From the foregoing description, it will be apparent that a container for carpenter squares has been developed which effectively immobilizes the squares thereby facilitating their safe and secure shipment. The one-piece construction of the container blank allows for economical manufacture while the unique combination of flaps and tabs permits rapid and easy concurrent assembly of the container and packaging of the squares. The container can readily accommodate varying numbers of squares and is adoptable to carpenter squares of different size. The closed container lends itself to automatic tape sealing and because of its regular rectangular shape is easy to handle, transport and stack. The problems associated with slippage of the packaged squares, manual rolling of corrugated material, and stapling shut of the container, are all avoided by the container of the present invention.

Accordingly, although a perferred embodiment of the container of this invention has been shown and described in detail, it is to be understood that numerous changes and variations can be made in the construction of the container without departing from the spirit of the invention, the scope of which is defined by the appended claims.

What is claimed is:

1. A container for packaging carpenter squares comprising:

(a) a substantially rectangular bottom panel capable of supporting carpenter squares arranged end to end in a rectangular pattern;

(b) a pair of tuck flaps extending from first and second edges, respectively, of said bottom panel and configured for folding over a portion of said carpenter squares, each tuck flap having an interlock flap extending therefrom configured for tucking underneath an opposing receiving flap; and (c) a pair of receiving flaps contained in said bottom panel, each receiving flap being configured and positioned to receive the opposing interlock flap thereunder and hold said interlock flap in place through interaction with said interlock flap.

2. A container for packaging carpenter squares as recited in claim 1, further comprising a pair of top flaps extending from third and fourth edges of said bottom panel.

3. A container for packaging carpenter squares as recited in claims 1 or 2 wherein said receiving flaps are substantially rectangular and are defined by: a cut-out parallel with an adjacent bottom panel edge, a pair of knife-cuts at each end of said cut-out running in a direction away from said adjacent edge of said bottom panel and a score line which is parallel to said cut-out and substantially perpendicular to said knife-cuts.

4. A container for packaging carpenter squares as recited in claims 1 or 2 wherein each tuck flap includes a pair of tabs, one tab of each pair being located on each side of the interlock flap of the tuck flap, each tab being provided with a score line which allows the tab to be folded under the adjacent tuck flap to enable said folded tab to act as a shim.

5. A container for packaging carpenter squares as recited in claim 3 wherein each tuck flap includes a pair of tabs, one tab of each pair being located on each side of the interlock flap of the tuck flap, each tab being provided with a score line which allows the tab to be folded under the adjacent tuck flap to enable said folded tab to act as a shim.

6. A container for packaging carpenter squares as recited in claim 4 wherein said tabs are defined on one side by an edge of the tuck flap and on the other side by a slice-cut.

7. A container for packaging carpenter squares as recited in claim 5 wherein said tabs are defined on one side by an edge of the tuck flap and on the other side by a slice-cut.

8. A container for packaging carpenter squares as recited in claim 6 wherein the slice-cut terminates in a punch-out.

9. A container for packaging carpenter squares as recited in claim 7 wherein the slice-cut terminates in a punch-out.

10. A container for packaging carpenter squares as recited in claims 1 or 2 wherein the tuck flaps have a score line to define the height of the container.

11. A container for packaging carpenter squares as recited in claim 3 wherein the tuck flaps have a score line to define the height of the container.

12. A container for packaging carpenter squares as recited in claims 1 or 2 wherein the interlock flaps extend from edges of said tuck flaps which edges are positioned non-adjacent to and substantially parallel with the first and second edges respectively of said bottom panel and wherein the interlock flaps each have a score line which is substantially parallel with the opposing receiving flap.

13. A container for packaging carpenter squares as recited in claim 3 wherein the interlock flaps extend from edges of said tuck flaps which edges are positioned non-adjacent to and substantially parallel with the first and second edges of said bottom panel and wherein the interlock flaps each have a score line which is substantially parallel with the opposing receiving flap.

14. A container for packaging carpenter squares as recited in claim 2 wherein the top flaps have a score line to define the height of the container.

15. A container for packaging carpenter squares as recited in claim 3 wherein the top flaps have a score line to define the height of the container.

16. A container for packaging carpenter squares as recited in claims 2 or 2 wherein said container is comprised of corrugated paper.

17. A container for packaging carpenter squares as recited in claim 3 wherein said container is comprised of corrugated paper.

18. A container for packaging carpenter squares as recited in claims 1 or 2 wherein said container is formed from a one-piece blank.

19. A container for packaging carpenter squares as recited in claim 3 wherein said container is formed from a one-piece blank.

20. A container for packaging carpenter squares comprising:

(a) a means for supporting said carpenter squares;

(b) a pair of means for folding over said carpenter squares; and (c) a pair of means for receiving and holding said folding means thereunder, sans additional holding means;

whereby the carpenter squares are packaged by being arranged on said support means, and immobilized by the folding means being folded over said carpenter squares and tucked underneath said receiving means.

21. A one-piece blank of corrugated material for packaging carpenter squares comprising:

(a) a substantially rectangular bottom panel capable of supporting carpenter squares arranged end to end in a rectangular pattern;

(b) a pair of tuck flaps extending from shorter edges of said bottom panel and configured for folding over a portion of said carpenter squares, each tuck flap having an interlock flap extending therefrom configured for tucking underneath an opposing receiving flap and, each tuck flap having score lines corresponding to the height of the container;

(c) a pair of receiving flaps contained in said bottom panel, each receiving flap being configured and positioned to receive the opposing interlock flap thereunder and hold said interlock flap in place through interaction with said interlock flap;

(d) A pair of top flaps extending from longer edges of said bottom panel, each top flap having a score line corresponding to the height of the container; and (e) a pair of tabs on each tuck flap, the tabs of each pair being located on alternate sides of the interlock flap of the tuck flap, each tab being provided with a score line which allows the tab to be folded under the adjacent tuck flap to enable said folded tab to act as a shim.

22. The one-piece blank of claim 21 wherein said receiving flaps are substantially rectangular and are defined by: a cut-out parallel with an adjacent bottom panel edge, a pair of knife-cuts at each end of said cut-out running in a direction away from said adjacent edge of said bottom panel, and a score line which is parallel to said cut-out and substantially perpendicular to said knife-cuts; and further comprising slice-cuts which define a border of said tabs with said interlock flaps, each slice-cut terminating in a punch-out.

* * * * *

UNITED STATES PATENT AND TRADEMARK OFFICE

CERTIFICATE OF CORRECTION

PATENT NO. : 4,957,204

DATED : September 18, 1990

INVENTOR(S) : Dooley

It is certified that error appears in the above-identified patent and that said Letters Patent is hereby corrected as shown below:

Claim 16 , Column 7 line 13, should read as follows:

16. --A container for packaging carpenter squares as recited in claims 1 or 2 wherein said container is comprised of corrugated paper--.

Signed and Sealed this

Third Day of December, 1991

*Attest:*

*Attesting Officer*

HARRY F. MANBECK, JR.

*Commissioner of Patents and Trademarks*